United States Patent [19]

Vogt

[11] 4,008,565

[45] Feb. 22, 1977

[54] TIMEPIECE HAVING AN OSCILLATING REGULATING MEMBER

[75] Inventor: Paul Vogt, Les Hauts-Geneveys, Switzerland

[73] Assignee: Ebauches S.A., Neuchatel, Switzerland

[22] Filed: Aug. 20, 1975

[21] Appl. No.: 606,120

[30] Foreign Application Priority Data

Sept. 6, 1974 Switzerland ..... 12130/74

[52] U.S. Cl. ..... 58/28 D; 58/117; 74/1.5

[51] Int. Cl.[2] ..... G04B 15/14; G04C 3/04

[58] Field of Search ..... 58/23 D, 23 TF, 23 V, 58/28 R, 28 A, 28 B, 107, 109, 116 R, 117, 28 D; 74/1.5

[56] References Cited

UNITED STATES PATENTS

| | | | |
|---|---|---|---|
| 3,670,493 | 6/1972 | Wuthrich | 58/28 D X |
| 3,685,279 | 8/1972 | Scholz | 58/28 D |
| 3,704,582 | 12/1972 | Wuthrich | 58/28 D |
| 3,834,155 | 9/1974 | Wuthrich | 58/28 D X |
| 3,887,825 | 6/1975 | Kumazawa | 58/28 D X |

*Primary Examiner*—Stanley J. Witkowski
*Attorney, Agent, or Firm*—Silverman & Cass, Ltd.

[57] ABSTRACT

A timepiece has a counting mechanism for counting the oscillations of the oscillating regulating member. The counting mechanism includes a plastic block with a retaining pawl and a driving pawl embedded within it. The block has a notch whose two walls serve to limit the movement of a first portion of the driving pawl which is embedded by one extremity in the block and passes through the notch to an elbow formed in the driving pawl which cooperates with the oscillating member to drive a ratchet wheel by a second driving portion of the driving pawl. The retaining pawl has one extremity embedded in an elastic portion of the block and the other cooperates with the ratchet. The block has an eccentric member abutting the elastic portion to adjust the position of the retaining pawl.

4 Claims, 2 Drawing Figures

TIMEPIECE HAVING AN OSCILLATING REGULATING MEMBER

Figure 1:
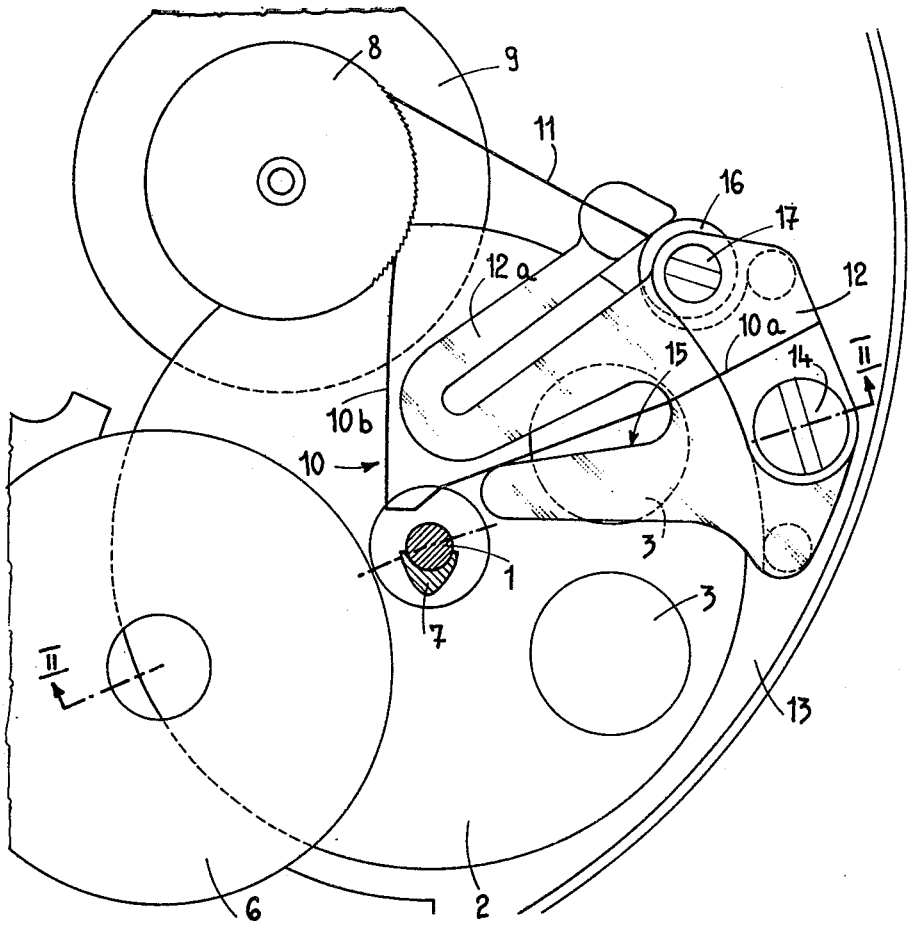

The present invention relates to a timepiece having an oscillating regulating member the oscillations of which are counted by means of a click mechanism comprising a ratchet wheel submitted to the action of a driving pawl and of a retaining pawl.

This timepiece is characterized by the fact that the counting mechanism comprises a block made of plastic material, mounted on the frame of the movement, and which carries two metallic blades. A first driving blade is bent at right angle and is embedded by the extremity of one of its portions in the material of the block and passes through a notch provided therein. The walls of the notch serve as abutting members which limit the movements of said portion. This blade cooperates by the other extremity of this same portion, in the vicinity of an elbow, with the oscillating regulating member which impels thereto a back and forth movement. The driving blade cooperating moreover, by the free extremity of a second portion, with the ratchet wheel. The second or retaining blade being embedded in an elastic portion of the block and cooperates with an eccentric abutting member carried by the block so that the position of the retaining blade is adjustable.

The drawing shows, by way of example, one embodiment of the object of the invention.

Figure 2:
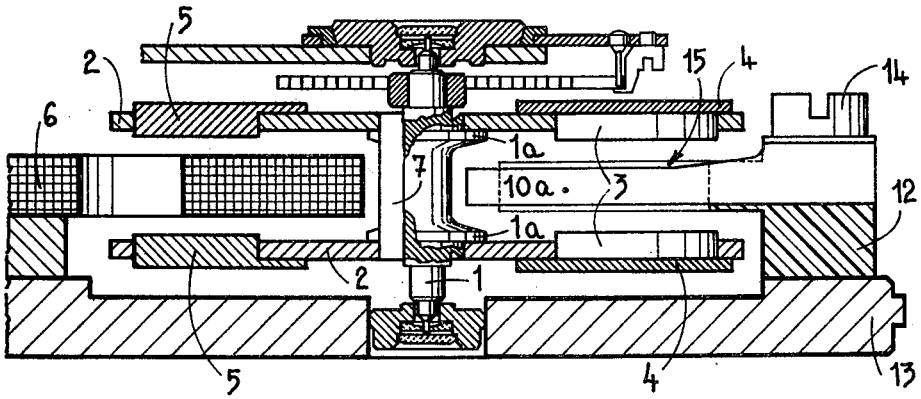

FIG. 1 is a plan view, with a partial section, of a part of an electric wrist-watch having a motor balance wheel, and FIG. 2 is a sectional view along line II-II of FIG. 1.

The timepiece represented comprises a motor balance wheel or oscillating member the shaft 1 of which carries two plates 2 each provided with two magnets 3 connected by an armature 4 having the shape of a segment of crown. These two plates carry each a counterweight 5 balancing the weight of the magnets and of their armature. The oscillations of this balance wheel are maintained electrically by means of a pancake coil 6 passing between two plates 2 and cooperating with the magnets 3. The electric circuit has not been represented, being known per se and being not part of the invention.

The shaft 1 of the balance wheel is provided with two shoulders 1*a* against each of which bears one of the plates 2 and which are traversed, as well as the plates, by a profiled rod or cam 7, parallel to the axis of the shaft 1 which constitutes a counting cam for counting the number of the oscillations of the balance wheel.

This counting is ensured by a ratchet wheel 8 rigid with a wheel 9 constituting the first element of a gearing driving the hands of the watch. This ratchet wheel is submitted to the action of two pawls, a driving one and a retaining one. These two pawls are constituted by two elastic blades 10 and 11, both carried by a block 12, made of plastic material, removably secured to the base plate 13 of the frame of the movement by a screw 14. The driving blade or pawl 10 is bent and is embedded, by the extremity of one of its two portions, designated by 10*a*, in the block 12, this portion 10*a* passing through a notch 15 provided in the said block 12 and the walls of which constitute two abutting members limiting the displacements of the said portion. The cam 7 cooperates with the portion 10*a* of the blade 10 in the vicinity of the opposed end of this portion, that is to say near an elbow of the blade, so as to impel thereto an oscillating movement. The second portion of the blade 10, designated by 10*b*, cooperates, by its free extremity, with the ratchet wheel 8. Owing to this special shape of the blade 10, one can use the flexibility of this blade for returning it resiliently. There is little risk that this blade will buckle or yield under the effect of the force due to the fact that it works substantially along its axis.

The retaining blade 11 is embedded in the extremity of an elastic arm 12*a* of the block of plastic material 12 and which is bearing on an eccentric 16 rigid with a control screw 17 carried by the block 12. Thus, by rotating the eccentric 16 by means of the screw 17, one displaces slightly the elastic arm 12*a* of the block 12 and, consequently, one modifies the position of the elastic blade 11, that permits to carry out a fine adjustment of the dephasing of the retaining pawl with respect to the driving pawl.

What I claim is:

1. A timepiece having a frame and having an oscillating regulating member, the oscillations of which are counted by means of a click counting mechanism including a ratchet wheel submitted to the action of a driving pawl and a retaining pawl, said click counting mechanism comprising:

two metallic blades constituting respectively said driving pawl and said retaining pawl, said driving blade being bent at substantially a right angle forming two portions with an elbow therebetween and being secured to said frame by an end of one of its portions and cooperating by the opposite end of said portion, substantially at said elbow, with said oscillating regulating member, which member imparts a back and forth movement to said driving blade, a free end of the second portion of said driving blade cooperating with said ratchet wheel.

2. A timepiece having a frame and having an oscillating regulating member, the oscillations of which are counted by a click counting mechanism including a ratchet wheel driven by a driving pawl and a retaining pawl, said click counting mechanism comprising:

a block made of plastic material, mounted on the frame of the timepiece, said block having a notch provided therein having two walls, and said block having an elastic portion which cooperates with an adjustable eccentric abutting member carried by said block, and having two metallic blades embedded by a first extremity in said block;

a first one of said blades acting as said driving pawl and having a first portion extending through said notch from said embedded extremity, having a substantially right angle bend forming an elbow outside said notch, a second portion extending from said elbow and having a free extremity, said blade cooperating substantially at said elbow with said oscillating regulating member which imparts a back and forth movement to said blade, with the movement limited by said walls of said notch, said free extremity of said second portion driving said ratchet wheel; and a second one of said blades acting as said retaining pawl, said first extremity embedded in said elastic portion of said block and a second extremity cooperating with said ratchet wheel, the position of said second blade being adjustable by adjusting said eccentric abutting member.

3. A timepiece as claimed in claim 2 wherein:

said elastic portion of said block including said second embedded blade, includes a bent arm of said block with said blade embedded in the free extremity thereof.

4. A timepiece as claimed in claim 2 wherein:

said oscillating regulating member is a balance wheel having a shaft which carries a cam which imparts said back and forth movement to said blade on each half-oscillation.

* * * * *